US005715547A

United States Patent [19]

Becker et al.

[11] Patent Number: 5,715,547

[45] Date of Patent: Feb. 10, 1998

[54] LAUNDRY BASIN

[75] Inventors: Allen R. Becker; Michael A. Funari; Donald A. Kubiak; Alex P. Marini, all of Erie, Pa.

[73] Assignee: Zurn Industries, Inc., Erie, Pa.

[21] Appl. No.: 640,654

[22] Filed: May 1, 1996

[51] Int. Cl.[6] ..... A47K 1/04

[52] U.S. Cl. ..... 4/619; 4/628; 4/630; 4/648; 4/650; 4/656

[58] Field of Search ..... 4/619, 628, 630, 4/637, 639, 640, 641, 643, 647, 648, 650, 651, 652, 653, 654, 656, 657, 605, 658; 211/16, 74, 65, 66, 75, 87, 105.1, 105.2, 123, 171, 204, 206, 100, 164; 206/77.1; 220/735, 736; 108/42, 26, 149; 248/317, 318, 339, 340

[56] References Cited

U.S. PATENT DOCUMENTS

| | | | |
|---|---|---|---|
| 62,082 | 2/1867 | Smith | 4/656 |
| D. 169,910 | 6/1953 | Mustee | D49/1 |
| D. 208,395 | 8/1967 | Mustee | D4/2 |
| D. 253,787 | 12/1979 | Kinsey | D23/61 |
| 539,195 | 5/1895 | Schlesinger . | |
| 652,289 | 6/1900 | Powell . | |
| 695,038 | 3/1902 | Craig | 4/653 |
| 886,933 | 5/1908 | Boyle | 211/123 |
| 964,857 | 7/1910 | Fredenhagen . | |
| 981,448 | 1/1911 | Matthews | 4/654 |
| 1,041,549 | 10/1912 | Winton | 211/123 |
| 1,370,088 | 3/1921 | Chervin | 4/641 |
| 1,394,287 | 10/1921 | Denning | 211/123 |
| 1,544,430 | 6/1925 | Brown | 4/656 |
| 1,949,353 | 2/1934 | Burman | 68/31 |
| 2,141,347 | 12/1938 | Davis | 4/654 |
| 2,259,166 | 10/1941 | Kendrick | 211/123 |
| 2,594,176 | 4/1952 | Kaiser, Jr. | 220/735 |
| 2,599,192 | 6/1952 | Miller | 108/149 |
| 2,780,241 | 2/1957 | Mustee | 137/590 |
| 3,233,744 | 2/1966 | Ripps | 108/26 |
| 3,333,282 | 8/1967 | Mustee | 4/187 |
| 3,364,503 | 1/1968 | Mustee | 4/647 |
| 3,427,664 | 2/1969 | Mustee | 4/183 |
| 3,591,871 | 7/1971 | Segal | 4/166 |
| 3,720,963 | 3/1973 | Zakaski | 4/628 |
| 3,975,781 | 8/1976 | Kimboff et al. | 4/170 |
| 4,496,125 | 1/1985 | Walsh et al. | 248/188 |
| 4,508,304 | 4/1985 | Mustee | 4/647 |
| 4,720,879 | 1/1988 | Rabban | 4/619 |
| 4,998,306 | 3/1991 | Klimke et al. | 4/619 |
| 5,349,708 | 9/1994 | Lee | 4/638 |

*Primary Examiner*—Charles R. Eloshway
*Attorney, Agent, or Firm*—Webb Ziesenheim Bruening Logsdon Orkin & Hanson, P.C.

[57] ABSTRACT

A laundry basin that includes a laundry basin body having a plurality of walls secured to a base and a plurality of legs secured to the body. A towel rack, a removable shelf and a removable soap dish are secured to the laundry basin body. The shelf includes a support member having brackets extending upwardly therefrom. The brackets define recesses that are adapted to receive portions of the laundry basin body. The soap dish includes a three-sided structure secured to a perforated bottom wall that defines an open side wall at an open top. The open side wall is positioned adjacent a laundry basin side wall to define an open topped receptacle adapted to receive a bottle of liquid soap. The towel rack is pivotally secured to the laundry basin body.

18 Claims, 8 Drawing Sheets

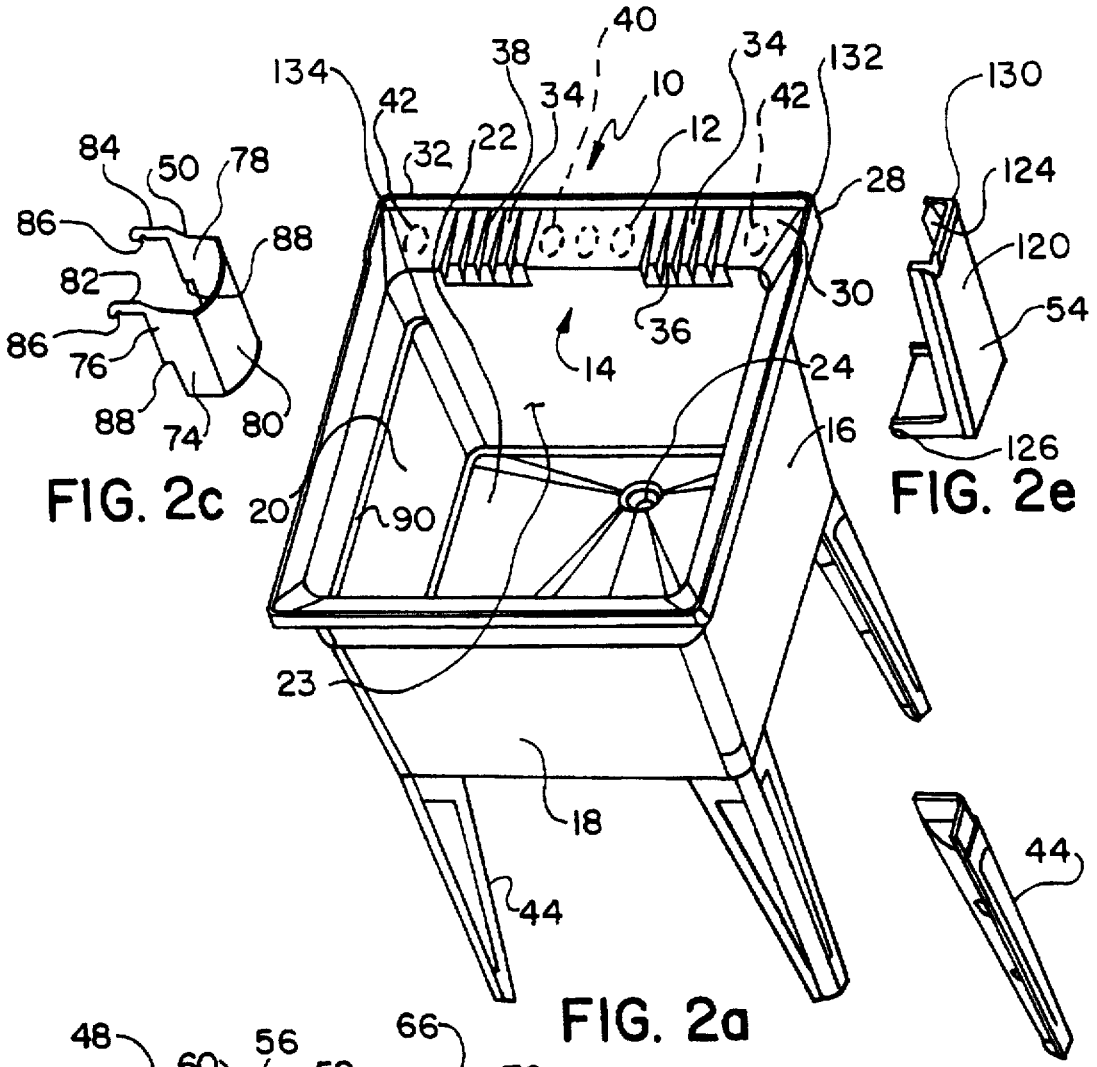
FIG. 2c
FIG. 2e
FIG. 2a
FIG. 2b
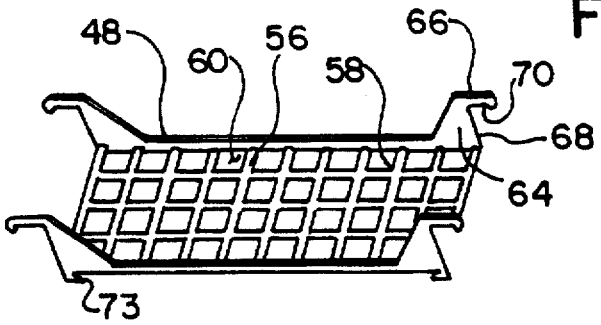
FIG. 2d
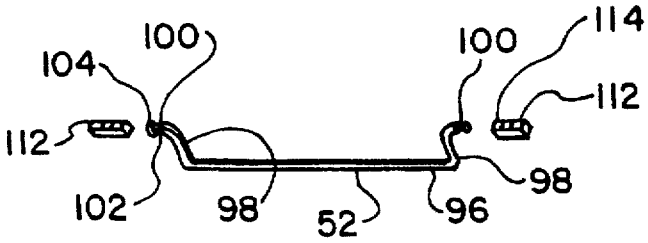
FIG. 2f

LAUNDRY BASIN

BACKGROUND OF THE INVENTION

1) Field of the Invention

This invention relates to laundry basins and, more particularly, to plastic laundry basins.

2) Description of the Prior Art

Most homes today include a clothes washer and a clothes dryer. Generally speaking, a laundry basin is positioned in close proximity to the clothes washer. Dirty water discharges from the clothes washer into the laundry basin. The laundry basin also generally includes a faucet for discharging hot and cold water.

Prior to the 1960's, laundry basins were made of metal. This resulted in an extremely heavy laundry basin, which was not only difficult to install, but difficult to remove. Many of these metal laundry basins are still in existence. In the 1960's, U.S. Pat. Nos. 3,333,282 and 3,427,664 disclosed molded plastic laundry basins. These lightweight laundry basins overcame the weight problem of the prior art metal wash basins. Today, Americans mostly purchase molded plastic laundry basins. Not only do plastic laundry basins weigh less than their metal counterparts, but plastic wash basins cost substantially less.

Generally speaking, American consumers will purchase the cheapest wash basin available. This results in fierce competition amongst laundry basin manufacturers to manufacture the least expensive product. However, in manufacturing the least expensive product, the manufacturers sacrifice not only quality, but also added features that the consumers may want.

It is believed that some consumers will purchase a more expensive laundry basin having added features. However, the cost of manufacturing such a laundry basin would be prohibitively expensive because of the limited quantities purchased, the cost of special molds and the additional labor involved.

Therefore, it is an object of our invention to provide a laundry basin that can be upgraded to include special features.

SUMMARY OF THE INVENTION

The present invention is a plastic laundry basin that includes a body portion and at least one of a towel rack, a removable shelf and a receptacle holder. A plurality of legs may be secured to the base. The towel rack includes a base portion and arms that extend from the base portion, wherein each of the arms are pivotally secured to the body. The removable shelf can include a plurality of brackets secured thereto for coacting with the laundry basin body. The receptacle holder can include a receptacle body having a side wall, a bottom wall secured to the side wall, wherein the receptacle body defines an open top. A clip extends from the receptacle body for removably securing the receptacle body to the laundry basin body. A wall hanger bracket can be provided to secure the body portion to a fixed structure, such as a basement wall, in which case support brackets are provided. The support brackets include a pin, which is received by a pin receiving hole defined by one of the body portion holes, and a tab by the body.

Another aspect of the invention is a method for manufacturing a plastic laundry basin that includes the steps of: securing legs to a laundry basin body, wherein the laundry basin body includes a base secured to a plurality of legs; and securing one of a removable shelf, a removable holder or a towel rack to the laundry basin body.

BRIEF DESCRIPTION OF THE DRAWINGS

FIG. 2*a* is a top perspective exploded view of the laundry basin body and legs shown in FIG. 1;

FIG. 2*b* is a top perspective view of a leg used in the laundry basin shown in FIG. 2*a;*

FIG. 2*c* is a top perspective view of a hanging soap dish made in accordance with the present invention;

FIG. 2*d* is a top perspective view of a drain shelf made in accordance with the present invention;

FIG. 2*e* is a top perspective view of a support bracket made in accordance with the present invention;

FIG. 2*f* is a towel rack made in accordance with the present invention;

DESCRIPTION OF THE PREFERRED EMBODIMENT

Figure 1:
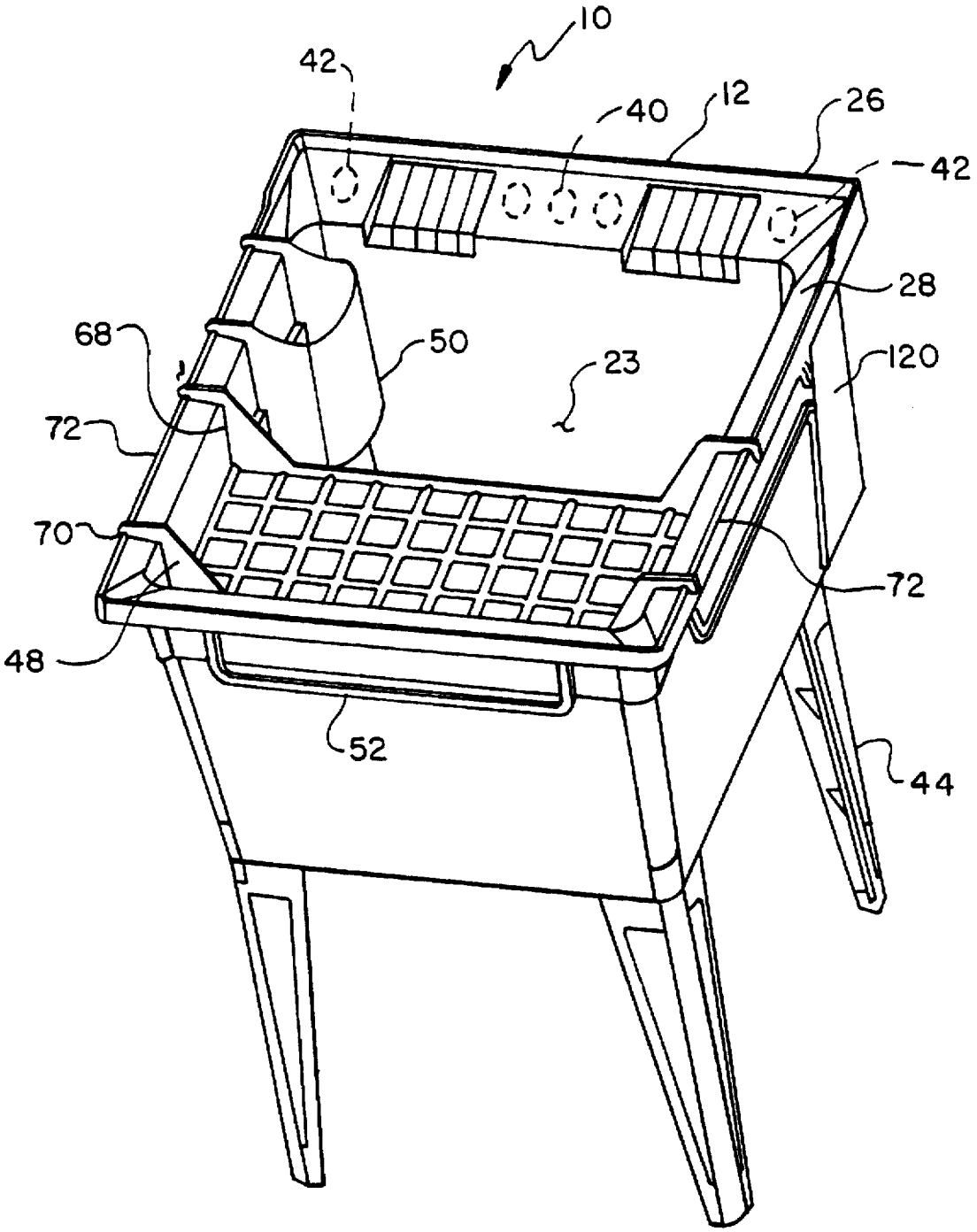
FIG. 1 is a top perspective view of a laundry basin made in accordance with the present invention.

FIG. 1 shows a laundry basin 10 made in accordance with the present invention. As shown in FIGS. 1 and 2*a*, the laundry basin 10 includes a unitary molded plastic open topped body 12, including vertically extending side walls 14, 16, 18 and 20 connected to a base 22. Side walls 14, 16, 18 and 20 and base 22 define a laundry basin interior area 23. The base 22 is angled and defines a drain hole 24. A ledge 26 extends from upper edges of side walls 14, 16, 18 and 20. The ledge 26 includes an angled base surface 28 connected to an upwardly extending lip 30 positioned about the perimeter of the base surface 28. The ledge 26 includes a rear portion 32 that defines two soap receiving portions 34. Each soap receiving portion 34 includes a sloping surface 36 having a plurality of upwardly extending ribs 38. Ribs 38 are adapted to have a bar of soap rest thereon. Any water that drips from the soap is directed into the laundry basin interior area 23 via channels defined by the sloping surface 36 and ribs 38.

A plurality of circular faucet knock-outs 40 are provided. Knock-outs 40 are perforated members of rear portion 32. Cutting the knock-outs 40 causes them to be removed from the rear portion 32, thereby causing circular holes to be formed. Faucet handles and a faucet spout can then be passed through the knock-out holes and secured to the rear portion 32 in a manner well-known in the art. Two other knock-outs 42 are provided which can be cut from the rear portion 32 for receipt of hoses, such as washing machine hoses, which can be passed through the resulting holes to discharge water into the laundry basin. Four removable plastic legs 44 are received by brackets 46 integrally formed on an underside of the base 22.

Figure 3:
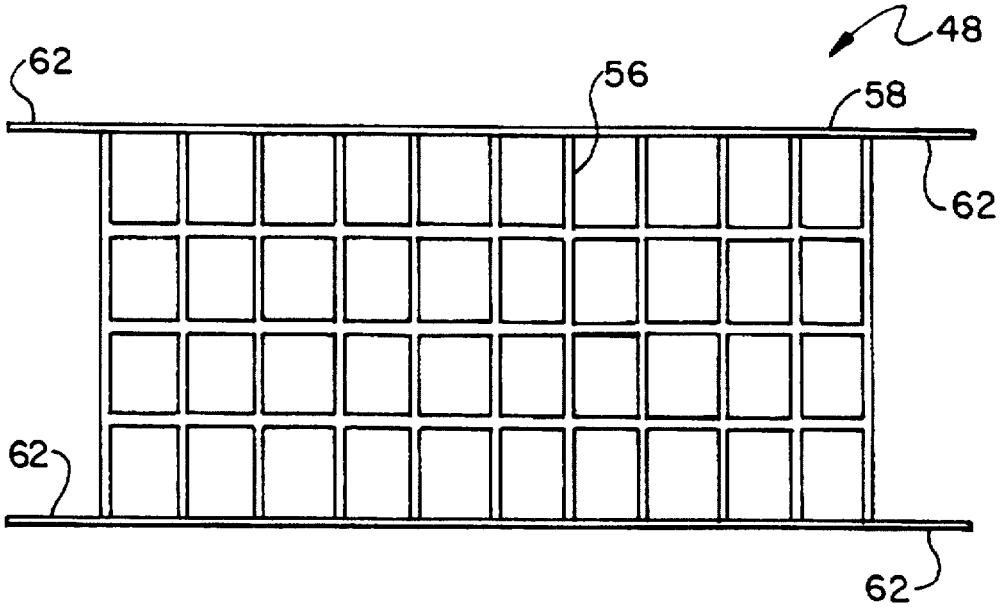
FIG. 3 is a top plan view of the drain shelf shown in FIG. 2*d;*
Figure 4:
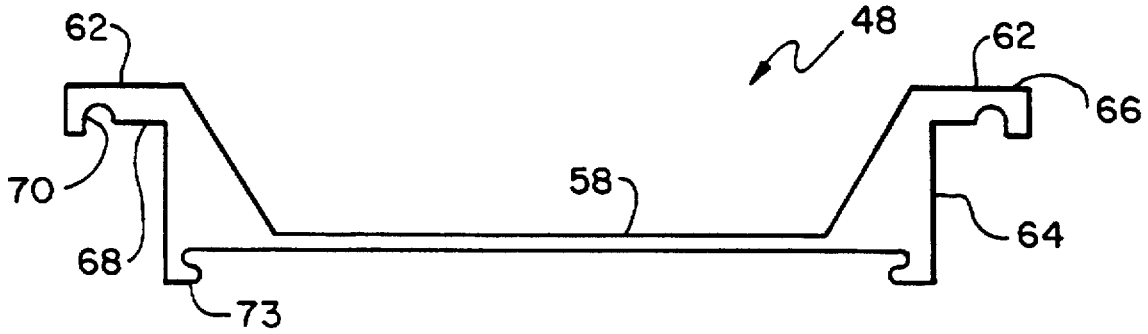
FIG. 4 is a side elevational view of the drain shelf shown in FIG. 2*d;*

The laundry basin 10 also includes a plastic drain shelf 48, a plastic hanging soap dish 50, a plastic towel rack 52 and a support bracket 54. As shown in FIGS. 2*d*, 3 and 4, the drain shelf 48 includes a plurality of segments 56 that define a rectangular support member 58. A plurality of openings 60 are defined by segments 56. Four integrally molded brackets 62 extend from support member 58. Each bracket 62 includes an upwardly extending first section 64 and a horizontally extending second section 66. Exterior surfaces of sections 64 and 66 define an L-shaped surface 68. A lip engaging U-shaped recess 70 is defined at an end of the L-shaped surface 68 adjacent a terminal end of the second section 66. The brackets 62 are removably positioned about the four corners of the support member 58. As shown in FIG. 1, opposite portions 72 of the extending lip 30 are received within recesses 70, and the L-shaped surfaces 68 abut against opposite portions of side walls 16 and 20 and ledge 26. The drain shelf removably attaches to the laundry basin 10 and various articles, such as wet towels or bottles, can be supported on the support member 58. One advantage of this arrangement is that water from the wet towels can drip through the openings 60 and into the base 22 of the laundry basin. Hanger clips 73 are defined on an underside of each bracket 62 so that rags or other material can be hung on the hanger clips 73.

Figure 5:
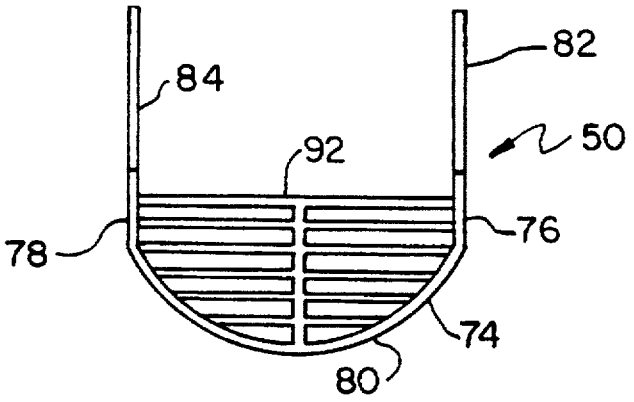
FIG. 5 is a top plan view of the hanging soap dish shown in FIG. 2*c;*
Figure 6:
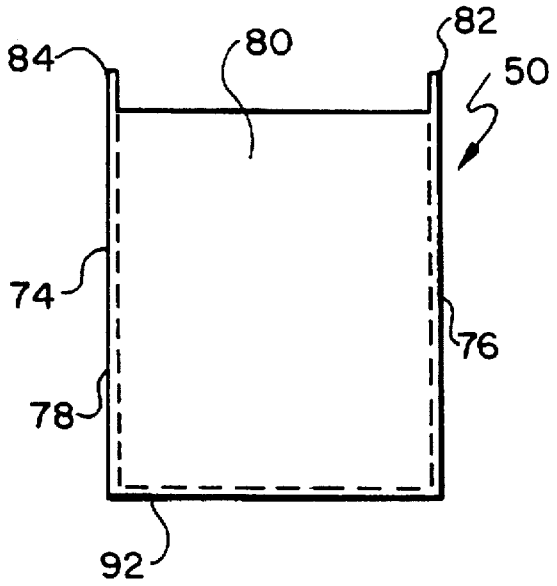
FIG. 6 is a front elevational view of the hanging soap dish shown in FIG. 2*c;*
Figure 7:
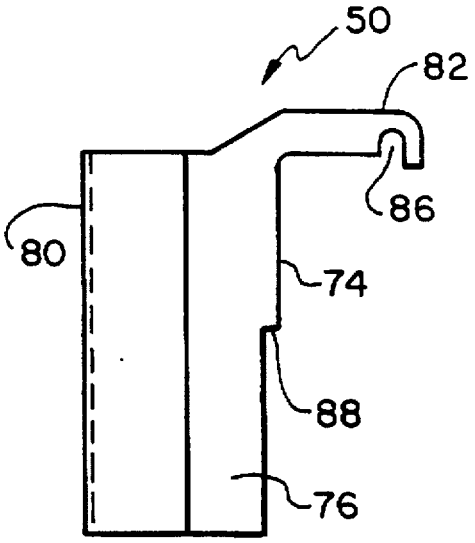
FIG. 7 is a side elevational view of the hanging soap dish shown in FIG. 2*c;*

As shown in FIGS. 2*c* and 5–7, the hanging soap dish 50 includes a three-sided body 74 that includes two opposite flat sides 76 and 78 attached to a curved side 80. Two arms 82 and 84 extend from upper portions of the flat sides 76 and 78. Each arm includes a notch portion 86 defined at a distal end thereof. An offset 88 is defined along exposed edges of flat sides 76 and 78. The offsets 88 are adapted to abut against laterally off-set upper portions 90 of the laundry basin. A perforated bottom 92, as shown in FIG. 5, is secured to bottom portions of sides 76, 78 and 80. As can be seen, the sides 76, 78 and 80 define an open top and an open side. Referring back to FIG. 1, in operation, the hanging soap dish notch portions 86 receive portions of the extending lip 30. The surfaces of arms 82 and 84 abut against ledge 26 and exposed edges of flat sides 76 and 78 abut against side wall 20 so that a rear wall is formed for the hanging soap dish 50, thereby forming an open faced receptacle in which, for example, a bottle of liquid soap can be received. If the hanging soap dish 50 is not needed, then it can be removed.

Figures 8A, 8B, 9:
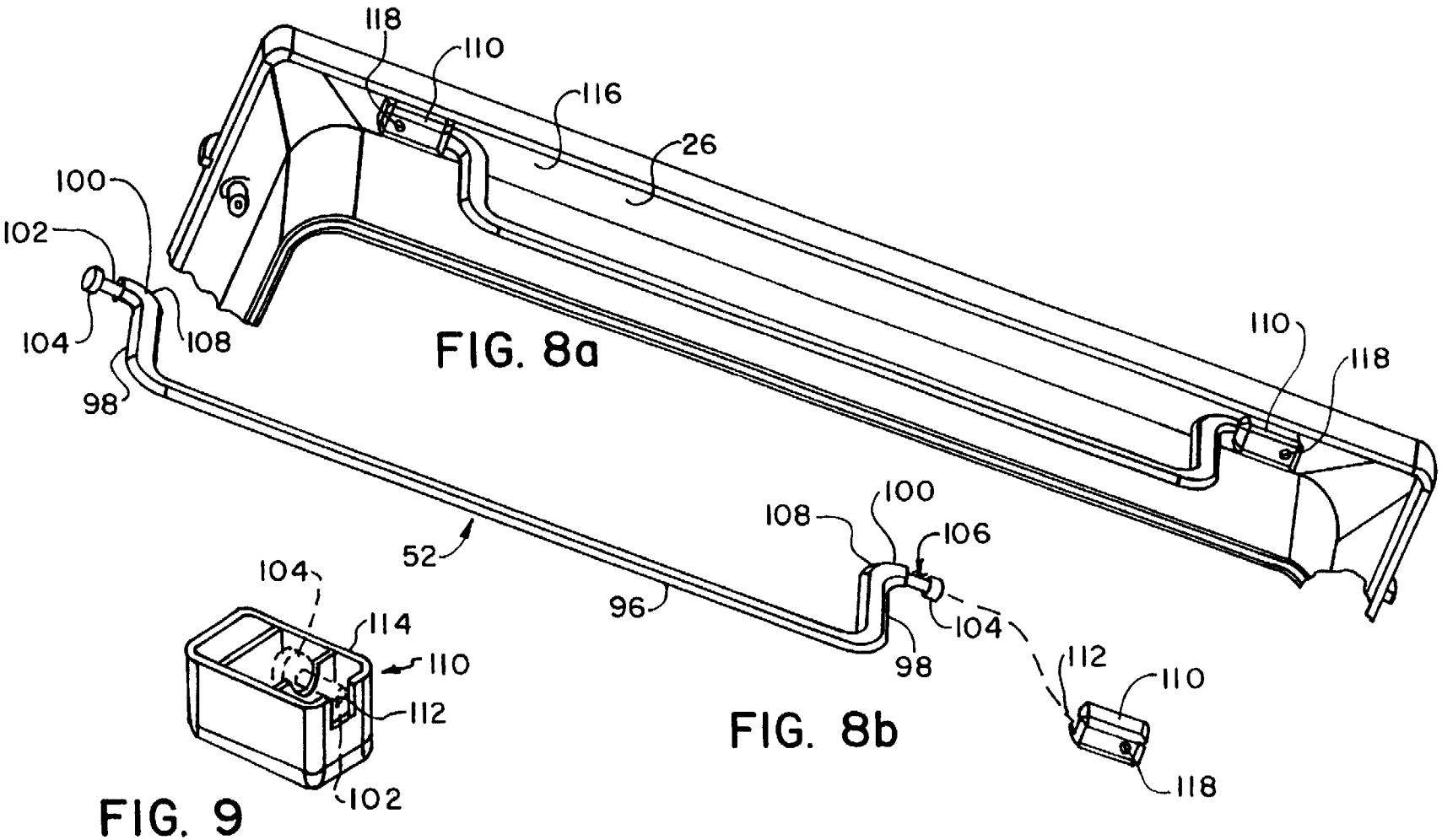
FIG. 8*a* is a bottom perspective view of a portion of the laundry basin and the towel rack shown in FIG. 2*f;*
FIG. 8*b* is an exploded view showing the towel rack and a towel rack securement bracket shown in FIG. 8*a;*
FIG. 9 is a perspective view of the towel rack securement bracket shown in FIG. 8*b;*

As shown in FIGS. 2*d*, 8*a*, 8*b* and 9, each of the towel racks 52 includes a base portion 96 and two extending arms 98 positioned at opposite ends thereof. Each of the arms 98 includes extending sections 100. With the exception of the extending sections, the base portion and arms have a square cross section. The extending sections 100 each include a cylindrical intermediate portion 102 and a cylindrical terminal portion 104. A recess 106 is defined between the terminal portion 104 and a first portion 108 of the extending section 100. Securement brackets 110 are provided that define a recessed area 112 on an open faced side 114 adapted to receive portions 102 and 104, which extend from portion 108. In operation, the respective portions 102 and 104 of each extending section 100 are received within recessed areas 112 of securement brackets 110 as shown in phantom in FIG. 9. Portions of extending sections 100 extend from slots defined on a forward face of the securement brackets 110 as shown in FIG. 8*a*. Open faced sides 114 abut against an underside 116 of ledge 26. Screws 118 pass through holes defined in the securement brackets 110 and secure the securement brackets 110 to the ledge 26. Preferably, the screws do not pass through the ledge 26, and the dimension of the recessed area 112 permits each towel rack 52 to rotate about an axis relative to securement brackets 110.

Figure 10A:
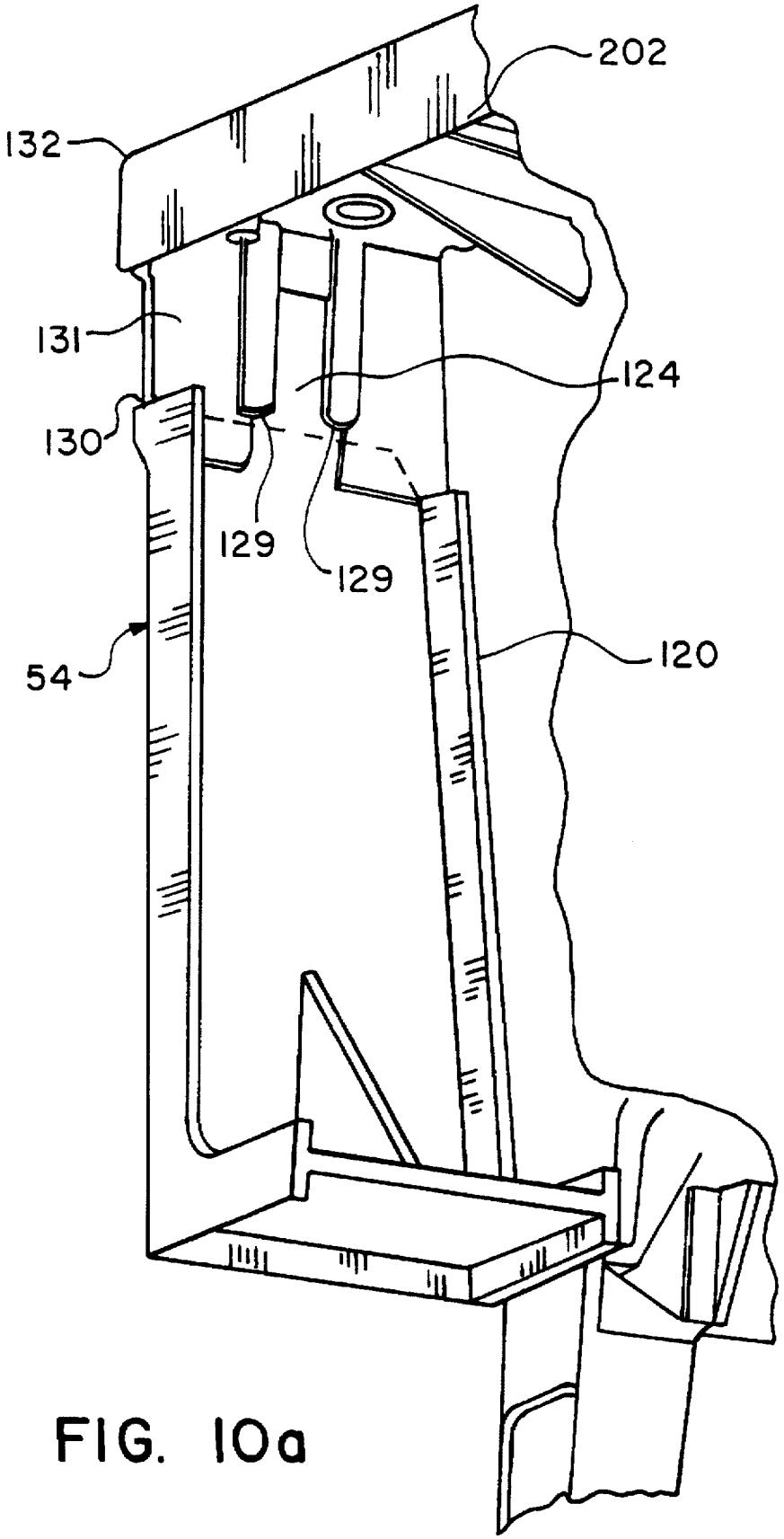
FIG. 10*a* is a rear perspective view of a portion of the laundry basin and the support bracket shown in FIGS. 1 and 2*e;*
Figure 10B:
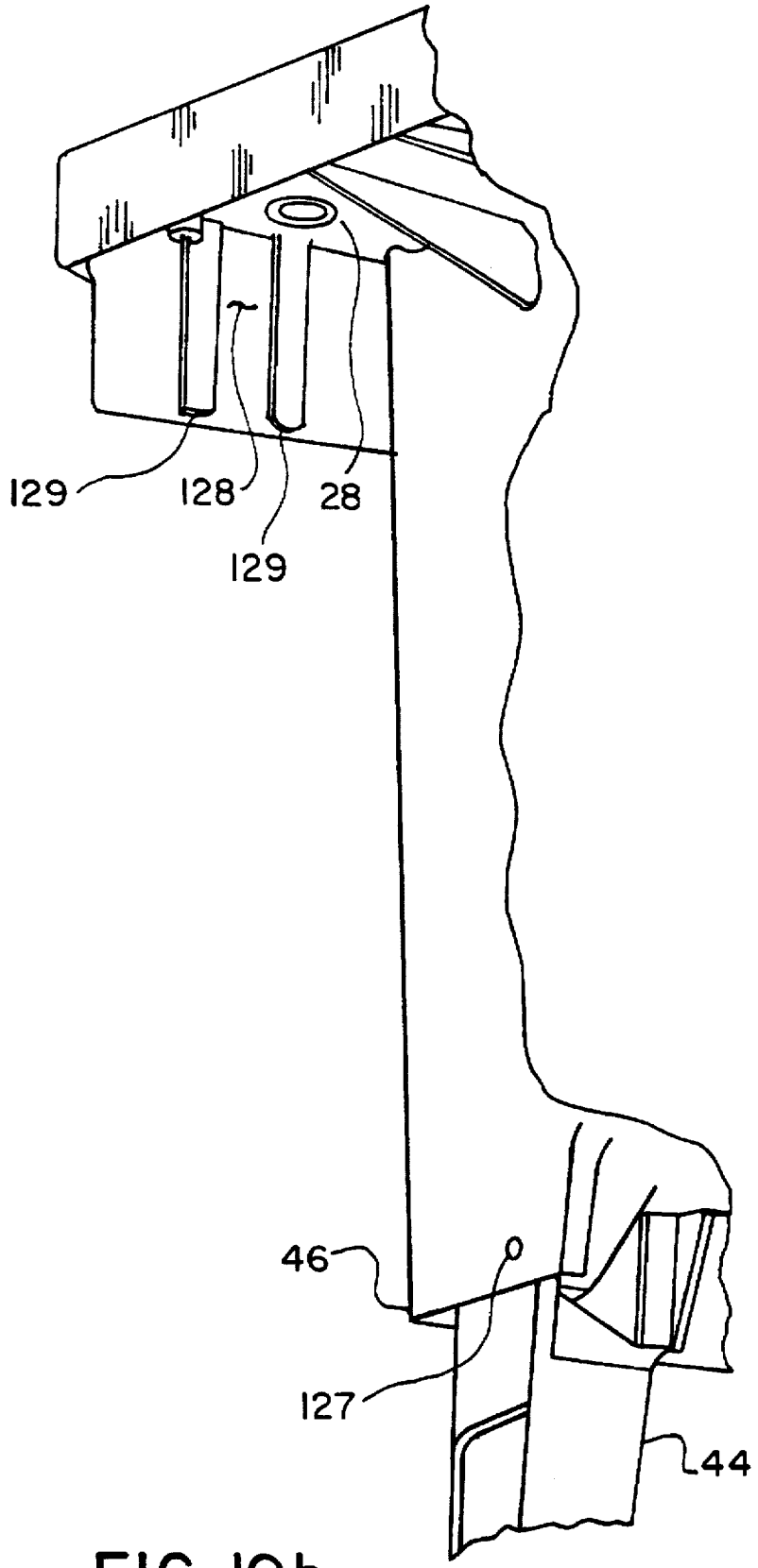
FIG. 10*b* is a rear perspective view of the portion of the laundry basin shown in FIG. 10*a* without the support bracket.
Figures 11, 12:
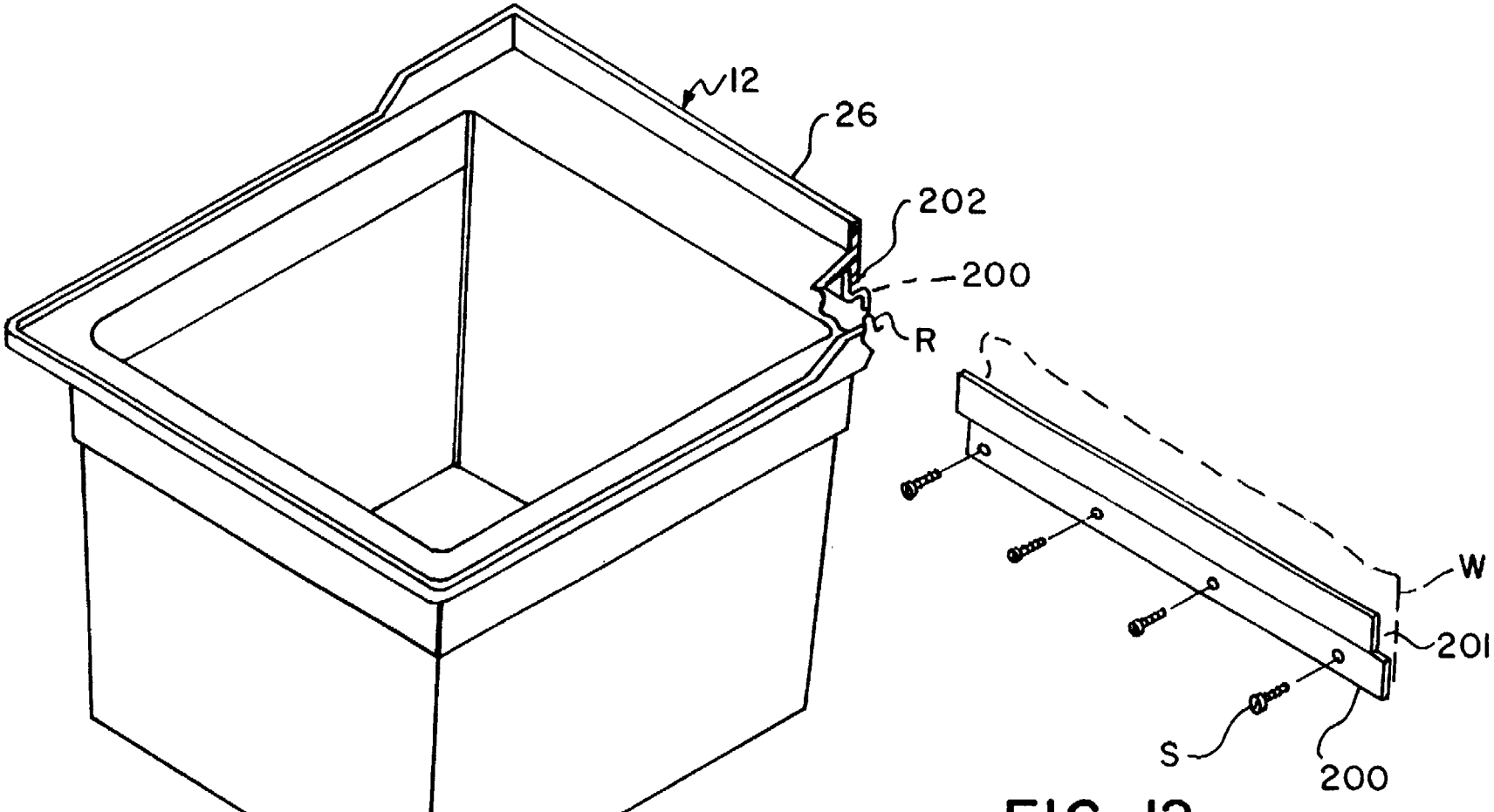
FIG. 11 is a top perspective view of the laundry basin body shown in FIG. 2*a* partially in section and a wall hanger bracket shown in phantom.
FIG. 12 is a top perspective view of the wall hanger bracket shown in FIG. 11.

As shown in FIGS. 2*e*, 10*a* and 10*b*, the support bracket 54 includes an L-shaped member or body 120 defined by two legs. A tab 124 extends vertically from one of the legs and a pin 126 extends laterally from the other of the legs. Two spaced apart blind pin holes 127 (of which only one is shown) are defined on an outer, lower surface of side wall 14 and tab receiving slots 128 (of which only one is shown) are defined on an underside of surface 28 by two spaced apart legs 129 and a wall 131 which depends from ledge 26. An L-shaped ledge receiving lip 130 is adapted to abut against ledge ends 132 and 134 as shown in FIG. 2*a*. In operation, two support brackets 54 are secured to opposite sides of the laundry basin 10 by passing the pins 126 in respective holes 127 and sliding the tabs 124 in the respective slots 128 in a tongue and groove arrangement where the tongue is defined by sides of tab 124 and the grooves are defined by legs 129 and the walls 131 so that wall ends adjacent ledge portions 132 and 134 rest in the receiving lips 130. Support brackets 54 fill in the recess "R" between a back wall "W" and side walls 16 and 20 and ledge 26 when the open topped body 12 is secured to a wall hanger 200 for support. As shown in FIGS. 11 and 12, the wall hanger 200 is a metal bracket that is secured to a wall "W" by screws "S". A recess 201 is defined between an upper portion of the wall hanger 200 and the wall to receive a lower depending portion 202 of the ledge 26 positioned adjacent side wall 14. Typically, the wall hanger 200 and the brackets 54 are used when legs 44 are not used with the laundry basin.

The present invention provides a laundry basin that can be provided with added features of the drain shelf 48, hanging soap dish 50, towel racks 52, support brackets 54 and/or wall hanger 200, without affecting the basic laundry basin body. Therefore, a purchaser can upgrade the wash basin whenever he or she wants to by purchasing one or more of these added features, or a kit can be provided supplying these added features. Hence, the laundry basin molds, including these features in a unitary design, need not be designed by the manufacturer. This results in a less expensive product for the consumers.

Having described the presently preferred embodiment of the invention, it is to be understood that it may otherwise be embodied within the scope of the appended claims.

We claim:

1. A plastic laundry basin comprising:

a body portion including a plurality of walls secured to a base defining a drain hole, a plurality of legs secured to said base, at least one of said walls having an upper portion laterally offset from a lower portion thereof, said walls including upper edges defining a wall perimeter, said body portion further including a horizontally extending ledge secured to said walls and extending about the wall perimeter, said ledge including an angled base surface connected to an upwardly extending lip positioned about a perimeter of said angled base surface.

2. A plastic laundry basin as claimed in claim 1, further comprising an add-on structure having a base portion and means for engaging said base portion to said ledge.

3. A plastic laundry basin as claimed in claim 2, wherein said add-on structure comprises a towel rack having a base portion and arms that extend from the base portion, each of said arms pivotally secured to said ledge.

4. A laundry basin as claimed in claim 3, wherein said towel rack is pivotally secured to said ledge through securement brackets.

5. A laundry basin as claimed in claim 4, wherein each of said arms includes an extending section that defines a recessed portion, each of said securement brackets defines a slot, each of said recessed portions received within said slot of a respective securement bracket.

6. A plastic laundry basin as claimed in claim 2, wherein said add-on structure comprises a shelf removably secured to said ledge of said laundry basin, said base portion of said shelf comprising a support member having a plurality of brackets secured thereto, wherein said brackets coact with said ledge.

7. A plastic laundry basin as claimed in claim 6, wherein each of said brackets comprises horizontally extending sections defining a recess that receives a portion of the upwardly extending lip.

8. A plastic laundry basin as claimed in claim 7, wherein each of said brackets further includes a vertically extending section, said vertically extending section and said horizontally extending section of a respective bracket define an L-shaped surface that coacts with the horizontally extending ledge and said laundry basin walls.

9. A plastic laundry basin as claimed in claim 6, wherein said support member defines a plurality of holes.

10. A plastic laundry basin as claimed in claim 2, wherein said add-on structure comprises a receptacle holder, said base portion of said receptacle holder comprising a receptacle body having a side wall portion and a bottom wall secured to said side wall portion, said receptacle body defining an open top, said receptacle holder further comprising a clip extending from said receptacle body for removably securing said receptacle body to said ledge so that said receptacle holder is positioned within said wall perimeter.

11. A plastic laundry basin as claimed in claim 10, wherein said side wall portion comprises two side walls and a front wall secured to said side walls defining an open top and an open side, whereby said receptacle side walls abut against a portion of one of said laundry basin side walls which forms a fourth wall of said receptacle body.

12. A plastic laundry basin as claimed in claim 11, wherein said clip comprises a horizontally extending arm extending from one of said side walls having a recess defined therein, said recess receiving said lip so that said clip coacts with said lip to hold the receptacle in place.

13. A plastic laundry basin as claimed in claim 12, wherein each of said side walls has an edge that is offset, which is adapted to coact with said laterally offset upper portion of said at least one of said laundry basin walls.

14. A plastic laundry basin as claimed in claim 10, wherein said bottom wall of said receptacle body defines a plurality of slots.

15. A plastic laundry basin comprising:

a body portion including a plurality of walls secured to a base defining a drain hole, said walls including upper edges defining a wall perimeter, said body portion further including a horizontally extending ledge secured to said walls and extending about the wall perimeter, said ledge including an angled base surface connected to an upwardly extending lip positioned about a perimeter of said angled base surface;

a plurality of legs secured to said base;

a towel rack secured to said ledge;

said towel rack comprising a base portion and arms that extend from the base portion, said arms pivotally secured to said ledge; and a shelf removably secured to said ledge, said shelf comprising a support member having a plurality of brackets secured thereto, wherein said brackets coact with said ledge.

16. A plastic laundry basin as claimed in claim 15 further comprising:

a receptacle holder comprising a receptacle body having a side wall, and a bottom wall secured to said side wall, said receptacle body defining an open top; and a clip extending from said receptacle body for removably securing said receptacle body to said ledge.

17. A plastic laundry basin comprising:

a body portion including a plurality of walls secured to a base defining a drain hole, said walls including upper edges defining a wall perimeter, said body portion further including a horizontally extending ledge secured to said walls and extending about the wall perimeter, said ledge including an angled base surface connected to an upwardly extending lip positioned about a perimeter of said angled base surface, one of said walls defining a pin hole, a rearward portion of said body portion defining a recess between said ledge and at least one of said walls;

means for securing said body to a fixed structure through said ledge; and a support bracket secured to said body, said support bracket including a support bracket body having a pin and tab extending from said body, said pin received by said pin hole and said tab received by said laundry basin body so that said support bracket is positioned within the recess.

18. A plastic laundry basin as claimed in claim 17, wherein said pin hole defined by said wall is a blind pin hole and said pin extending from said support bracket body is a laterally extending pin.

* * * * *